US009284734B1

(12) United States Patent
Inzeo et al.

(10) Patent No.: US 9,284,734 B1
(45) Date of Patent: Mar. 15, 2016

(54) DRIP EDGE

(71) Applicants: Joseph A. Inzeo, West Allis, WI (US); Brad D. Van Dam, Menomonee Falls, WI (US)

(72) Inventors: Joseph A. Inzeo, West Allis, WI (US); Brad D. Van Dam, Menomonee Falls, WI (US)

( * ) Notice: Subject to any disclaimer, the term of this patent is extended or adjusted under 35 U.S.C. 154(b) by 0 days.

(21) Appl. No.: 14/801,864

(22) Filed: Jul. 17, 2015

Related U.S. Application Data

(60) Provisional application No. 62/031,172, filed on Jul. 31, 2014.

(51) Int. Cl.

| | |
|---|---|
| ***E04D 13/04*** | (2006.01) |
| ***E04B 1/66*** | (2006.01) |
| ***E04D 13/155*** | (2006.01) |
| ***E04D 13/15*** | (2006.01) |
| ***E04D 3/40*** | (2006.01) |
| *E04B 1/38* | (2006.01) |

(52) U.S. Cl.
CPC ..... *E04D 13/0459* (2013.01); *E04B 1/66* (2013.01); *E04B 1/665* (2013.01); *E04D 3/405* (2013.01); *E04D 13/15* (2013.01); *E04D 13/155* (2013.01); *E04B 2001/405* (2013.01); *E04D 2013/0468* (2013.01)

(58) Field of Classification Search
CPC ..... E04B 1/66; E04B 1/665; E04B 1/40; E04B 2001/405; E04D 13/155; E04D 13/15; E04D 3/405; E04D 2003/285; E04F 19/02
USPC ..... 52/60, 96, 300, 58, 97, 716.2, 94, 52/718.04, 741.4
See application file for complete search history.

(56) References Cited

U.S. PATENT DOCUMENTS 3,507,470 A * 4/1970 Gobel ..... E04D 13/15 248/205.1
4,070,806 A * 1/1978 Hubbard ..... E04B 2/96 52/395
4,665,667 A * 5/1987 Taylor ..... E04D 13/155 52/96
4,707,954 A * 11/1987 Butzen ..... E04D 13/155 52/60
4,780,997 A * 11/1988 Taylor ..... E04D 13/155 52/96
4,848,045 A * 7/1989 Nichols ..... E04D 13/155 52/60
4,858,406 A * 8/1989 Lane ..... E04D 3/405 52/300
5,123,208 A * 6/1992 Kirby ..... E04D 13/1415 52/58
5,189,853 A * 3/1993 Braine ..... E04D 13/15 52/219
5,927,023 A * 7/1999 Kittilstad ..... E04D 13/155 52/60
6,845,590 B1 * 1/2005 Mills, Jr. ..... E04D 13/155 52/60
6,851,229 B2 * 2/2005 Inzeo ..... E04D 13/155 428/71
6,912,814 B1 * 7/2005 Inzeo ..... E04D 3/405 52/300
7,451,572 B1 11/2008 Inzeo et al.
7,647,730 B1 * 1/2010 Inzeo ..... E04D 13/155 52/300
7,748,173 B1 * 7/2010 Inzeo ..... E04D 3/405 52/300

* cited by examiner

*Primary Examiner* — Robert Canfield
*Assistant Examiner* — Matthew Gitlin
(74) *Attorney, Agent, or Firm* — Donald J. Ersler

(57) ABSTRACT

A drip edge preferably includes an anchor bar and a cover plate. The anchor bar includes a base portion, an offset leg, a cover flange, a clip flange, a drip flange and a sealing flange. A plurality of fastener openings are formed through a length of the base portion. An offset leg extends from a bottom of the base portion and the cover flange extends from a bottom of the offset leg. The sealing flange extends inward from a top of the base portion. The drip flange extends outward from the top of the base portion. The clip flange extends outward from the base portion, below the drip flange. A retention projection extends upward from an end of the clip flange. The cover plate includes a top clip end and a bottom clip end. The top clip end includes an inward extending snap lock.

19 Claims, 6 Drawing Sheets

DRIP EDGE

CROSS-REFERENCES TO RELATED APPLICATIONS

This is a non-provisional patent application, which claims the benefit of provisional application No. 62/031,172 filed on Jul. 31, 2014.

BACKGROUND OF THE INVENTION

1. Field of the Invention

The present invention relates generally to roofing and more specifically to a drip edge, which does not require a secondary operation to waterproof a roof flange where the drip edge is fastened.

2. Discussion of the Prior Art

U.S. Pat. No. 7,451,572 to Inzeo et al. discloses a roof fascia with extension cleat. However, Inzeo et al. does not teach or suggest the use of the roof fascia as a drip edge.

Accordingly, there is a clearly felt need in the art for a drip edge, which does not require anchoring in a top of a roof and which does not require a secondary operation to waterproof a roof flange where the drip edge is fastened.

SUMMARY OF THE INVENTION

The present invention provides a drip edge, which does not require anchoring in a top of a roof. The drip edge preferably includes an anchor bar and a cover plate. The anchor bar includes a base portion, an offset leg, a cover flange, a clip flange, a drip flange and a sealing flange. A plurality of fastener openings are formed through a length of the base portion. A plurality of horizontal grooves are formed in the base portion, adjacent the offset leg. The offset leg extends from a bottom of the base portion and the cover flange extends from a bottom of the offset leg. The sealing flange extends inward from a top of the base portion. A plurality of lengthwise grooves are formed in a bottom of the sealing flange. The drip edge extends outward from the top of the base portion. The clip flange extends outward from the base portion, below the drip edge. A retention projection extends upward from an end of the clip flange. The cover plate includes a top clip end and a bottom clip end. The top clip end includes an inward extending snap lock.

In use, a roofing membrane extends over an edge of the roof and downward. A non-curing sealant is applied to the plurality of lengthwise grooves. The base portion is secured to a vertical edge of a roof by inserting a plurality of fasteners into the plurality of fastener openings and securing the plurality of fasteners to the vertical edge of the roof. The plurality of horizontal grooves engage the roof membrane. The bottom clip end of the cover plate is slipped under the cover flange and the cover plate is rotated relative to the cover flange and pushed toward the base portion. The snap lock snaps over the retention projection to secure the cover plate to the anchor bar.

Accordingly, it is an object of the present invention to provide a drip edge, which does not require anchoring in a top of a roof.

Finally, it is another object of the present invention to provide a drip edge, which does not require a secondary operation to waterproof a roof flange where the drip edge is fastened.

These and additional objects, advantages, features and benefits of the present invention will become apparent from the following specification.

DETAILED DESCRIPTION OF THE PREFERRED EMBODIMENTS

Figure 1:
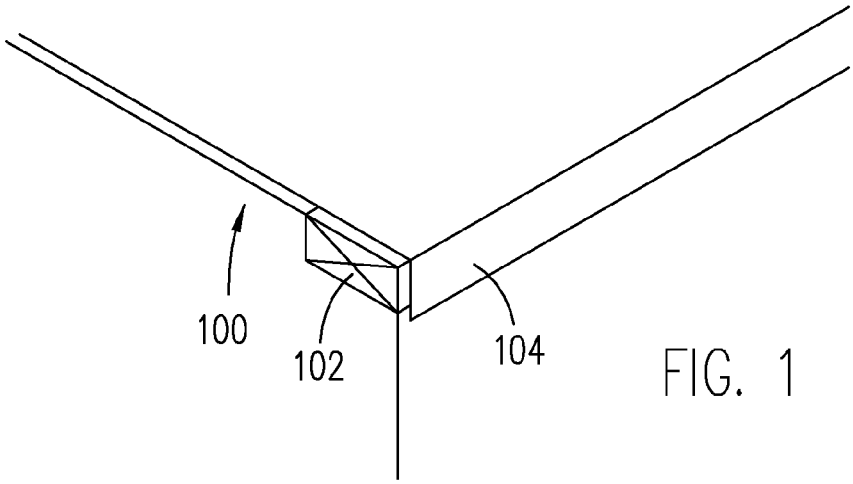
FIG. 1 is a perspective view of a roof with a roofing membrane extending over an edge thereof.
Figure 5:
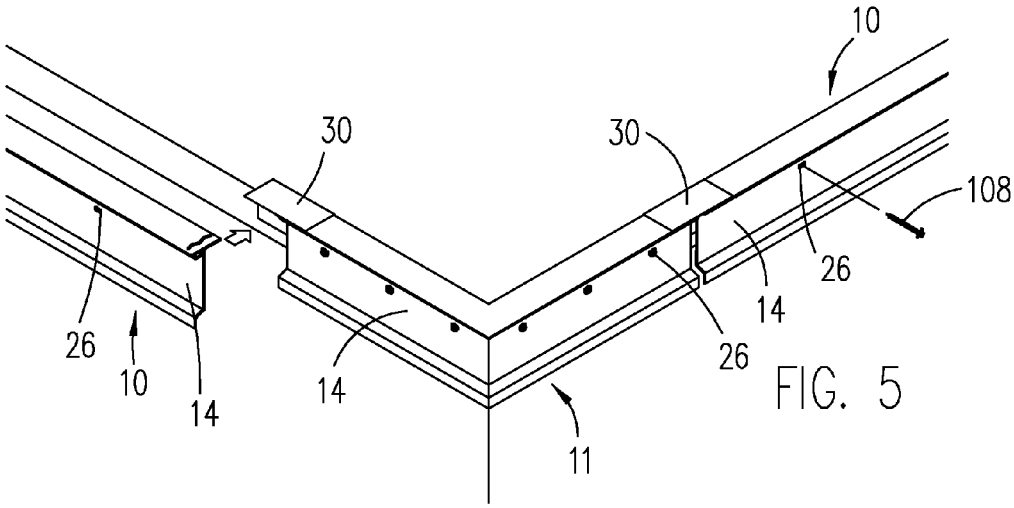
FIG. 5 is a perspective view of a corner drip edge and two drip edges before being joined with two flange splices in accordance with the present invention.
Figure 6:
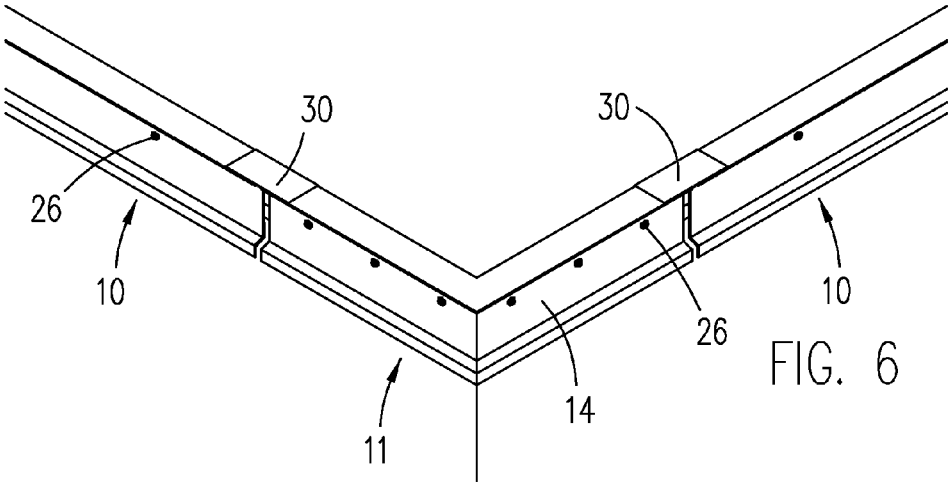
FIG. 6 is a perspective view of a corner drip edge and two drip edges after being joined with two flange splices in accordance with the present invention.
Figure 7:
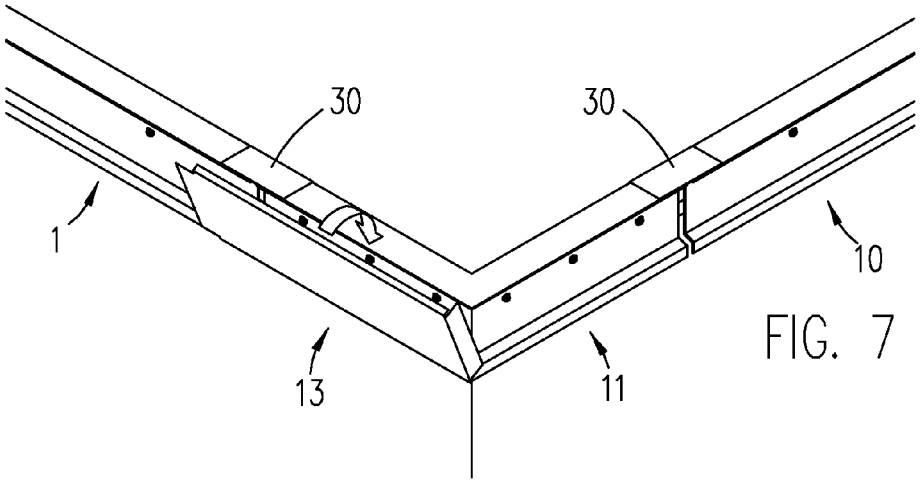
FIG. 7 is a perspective view of a corner drip edge, two drip edges and a cover plate before attachment thereof to the corner drip edge in accordance with the present invention.
Figure 8:
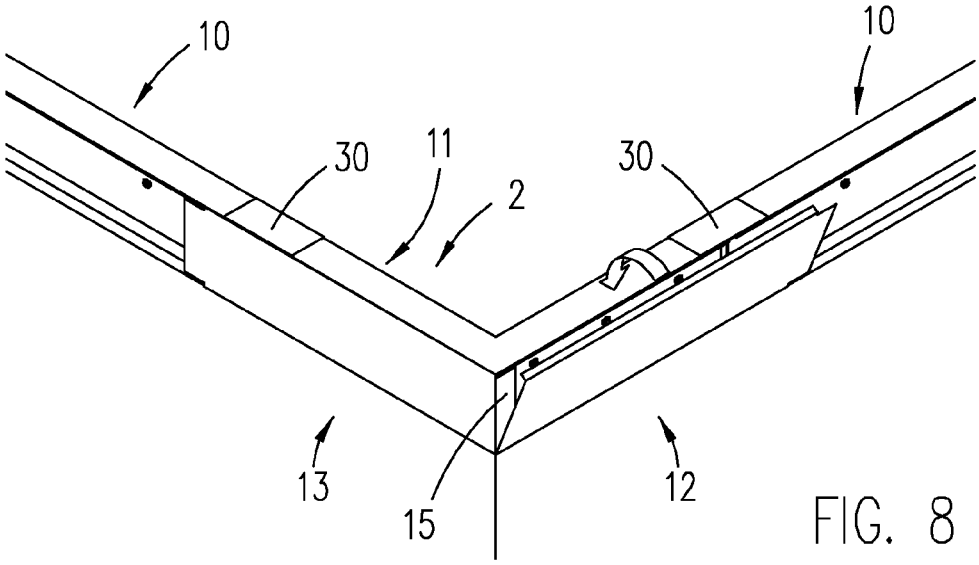
FIG. 8 is a perspective view of a corner drip edge; two drip edges; a cover plate attached to the corner drip edge and a second cover plate before attachment to the corner drip edge in accordance with the present invention.
Figure 9:
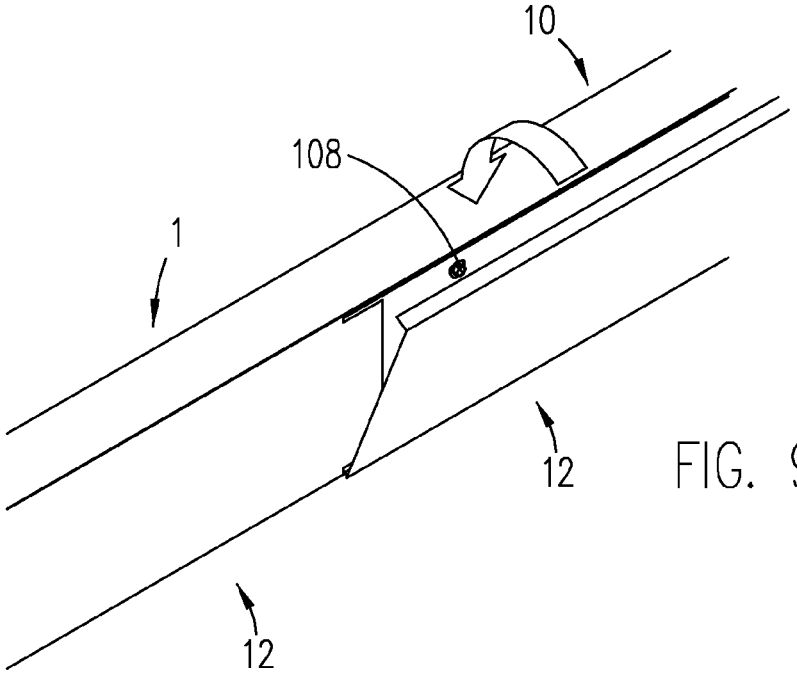
FIG. 9 is a perspective view of a drip edge and a cover plate before attachment thereof to the drip edge in accordance with the present invention.
Figure 10:
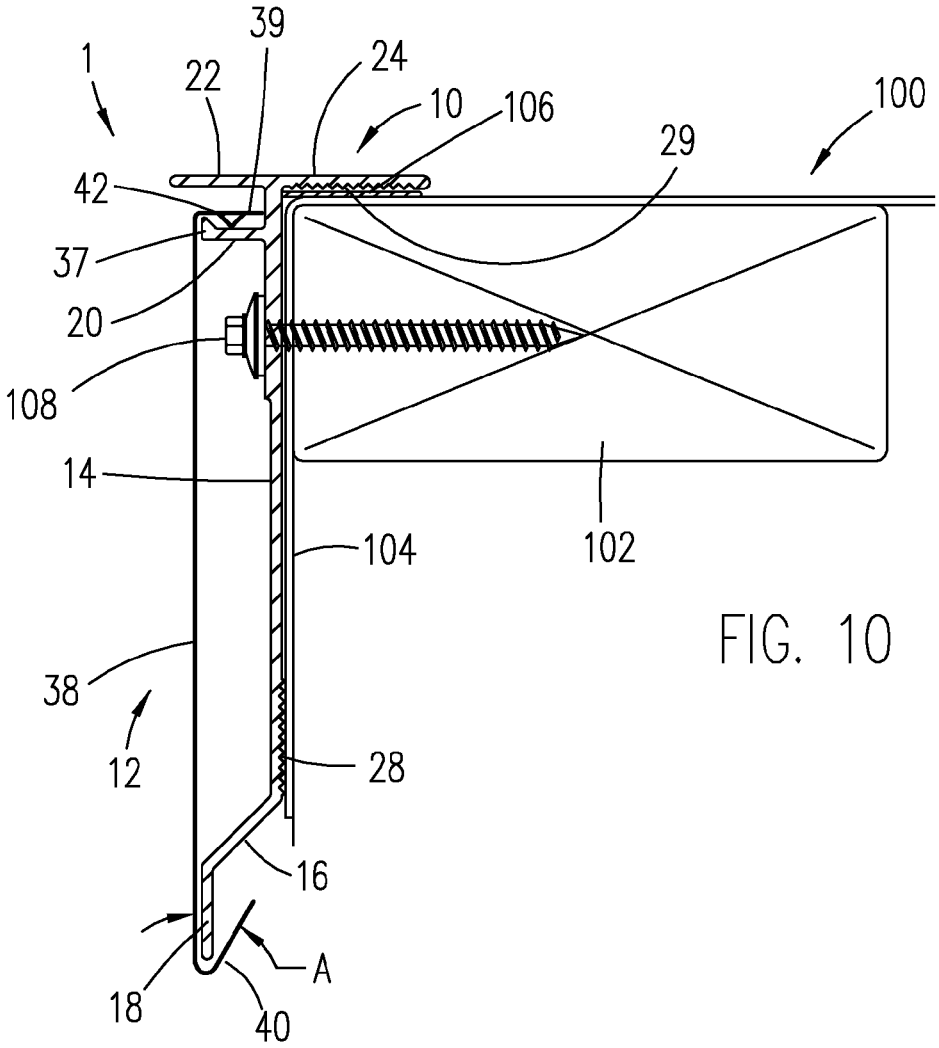
FIG. 10 is an end view of a drip edge attached to a roof in accordance with the present invention.

With reference now to the drawings, and particularly to FIG. 10, there is shown an end view of a drip edge 1 attached to an edge of a roof 100. With reference to FIG. 1, a nailing stud 102 is formed on an edge of the roof 100. A roof membrane 104 extends over an end of the nailing stud 102. With reference to FIG. 10, the drip edge 1 preferably includes an anchor bar 10 and a cover plate 12. With reference to FIG. 8, a corner anchor bar 11 essentially includes two anchor bars 10 joined to each other to form an L-shape. The anchor bar 10 includes a base portion 14, an offset leg 16, a cover flange 18, a clip flange 20, a drip flange 22 and a sealing flange 24. With reference to FIG. 5, a plurality of fastener openings 26 are formed through a length of the base portion 14. A plurality of horizontal grooves 28 are formed in an inside surface of the base portion 14, adjacent the offset leg 16. The offset leg 16 extends from a bottom of the base portion 14 and the cover flange 18 extends from a bottom of the offset leg 16. The sealing flange 24 extends inward from a top of the base portion 14. A plurality of lengthwise grooves 29 are formed in a bottom surface of the sealing flange 24.

With reference to FIG. 8, a corner drip edge 2 includes the corner anchor bar 11, a cover plate 12 and a corner cover plate 13. With reference to FIGS. 3-6, a flange splice 30 is slipped on to opposing ends of the corner drip edge 2. With reference to FIG. 8, the flange splice 30 joins two adjacent drip edges 1 or an adjacent drip edge 1 and corner drip edge 2. The flange splice 30 is preferably fabricated from a single piece of material. The flange splice 30 preferably includes a base flange 32, a bottom flange 34 and a top flange 35. One end of the bottom flange 34 extends outward from a top of the base flange 32.

The top flange 35 extends in an opposite direction from the other end of the bottom flange 34. A flange gap 36 is created between the bottom and top flanges 34, 35. The flange gap 36 is sized to receive a thickness of the sealing flange 24. A non-curing sealant 106 is preferably placed in a corner junction between the base flange 32 and the bottom flange 34.

Figure 2:
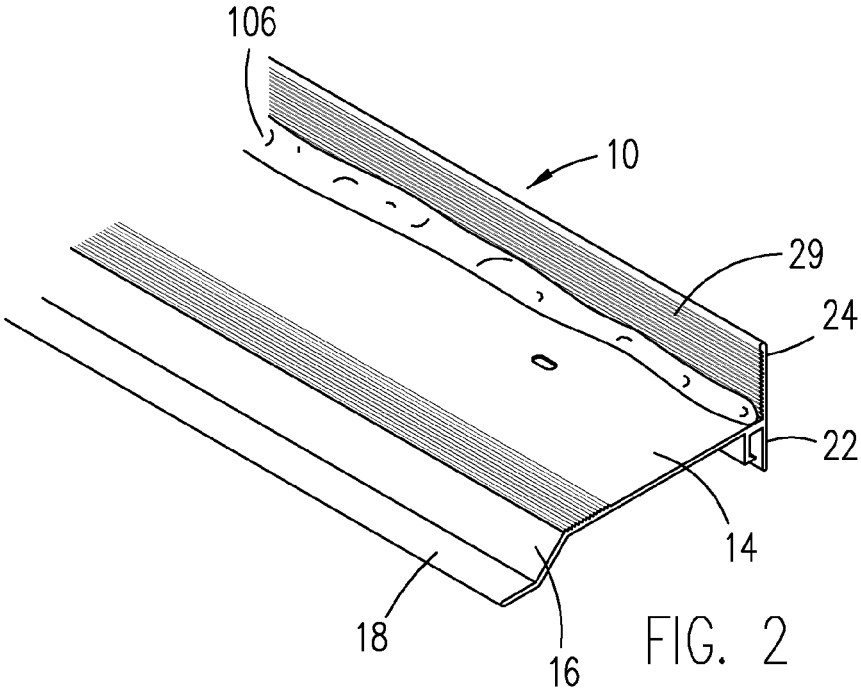
FIG. 2 is a bottom perspective view of an anchor bar of a drip edge after application of a non-curing sealant in accordance with the present invention.
Figure 3A:
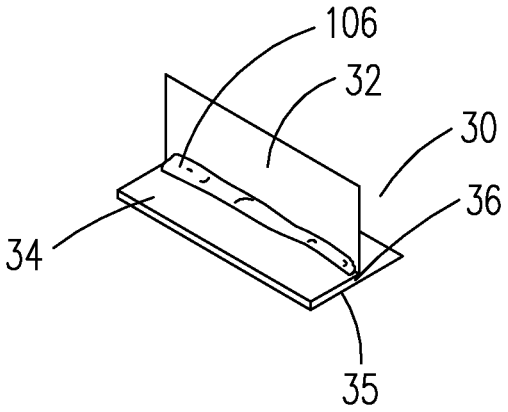
FIG. 3*a* is an enlarged bottom perspective view of a flange splice of a drip edge in accordance with the present invention.
Figure 3:
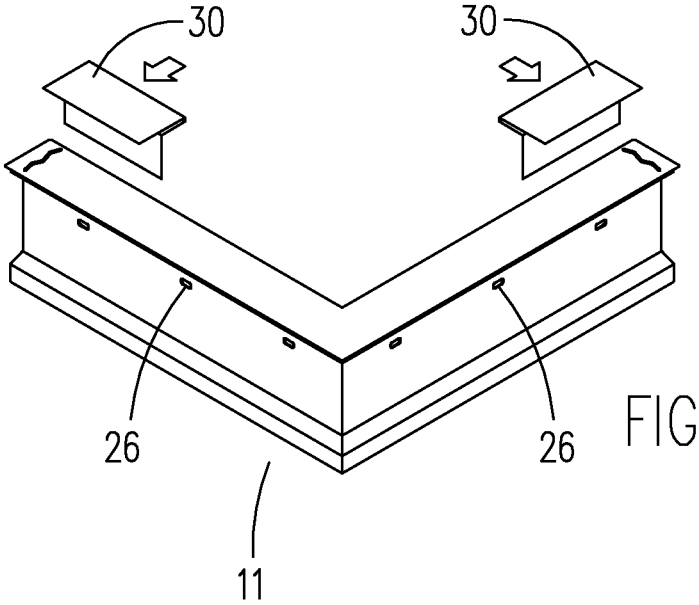
FIG. 3 is an exploded perspective view of a corner drip edge and two flange splices in accordance with the present invention.
Figure 4:
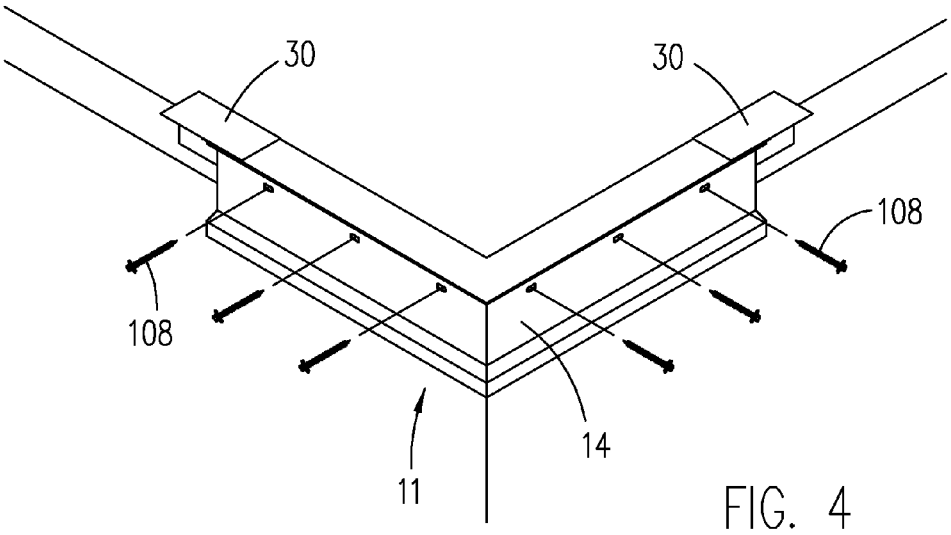
FIG. 4 is a perspective view of a corner drip edge with two flange splices retained thereon in accordance with the present invention.

With reference to FIGS. 2 and 10, the non-curing sealant 106 is placed in the plurality of lengthwise grooves 29. The drip flange 22 extends outward from a top of the base portion 14. The clip flange 20 extends outward from the base portion 14, below the drip flange 22. A retention projection 37 extends upward from an end of the clip flange 20. With reference to FIG. 10, the cover plate 12 includes a plate portion 38, a top clip end 39 and a bottom clip end 40. The top clip end 39 extends substantially perpendicular from a top of the plate portion 38. The bottom clip end 40 extends from a bottom of the plate portion 38 at an acute angle "A." An inwardly extending snap lock 42 is formed in the top clip end 39. The corner cover plate 13 includes the cover plate 12 terminated on an end with a corner end plate 15.

In use, the roofing membrane 104 extends over an edge of the roof 100 and downward. The non-curing sealant 106 is applied to the plurality of lengthwise grooves 29. The sealing flange 24 is brought in contact with a top of the roof membrane 104. With reference to FIGS. 3-6, the base portion 14 of the anchor bar 10 and the corner anchor bar 11 are secured to a vertical portion of the nailing stud 102 by inserting a plurality of fasteners 108 into the plurality of fastener openings 26 and securing the plurality of fasteners 108 to the nailing stud 102. The plurality of horizontal grooves 28 engage the roof membrane 104. With reference to FIGS. 7-10, the bottom clip end 40 of the cover plate 12 is slipped under the cover flange 18 and the cover plate 12 is rotated relative to the cover flange 18 and pushed toward the base portion 14. The snap lock 42 snaps over the retention projection 37 to secure the cover plate 12 to the anchor bar 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A drip edge for attachment to an edge of a roof, comprising:

an anchor bar includes a base portion, a drip flange, a sealing flange, a cover flange and a clip flange, said drip flange extends outward from a top of said base portion, said sealing flange extends from said top of said base flange in a direction opposite said drip flange, said cover flange extends from a bottom of said base portion, said clip flange extends outward from said base portion below said drip flange; and a cover plate includes a plate portion, a top clip end and a bottom clip end, said top clip end extends inward from a top of said plate portion, said bottom clip end extends inward from a bottom of said plate portion, wherein said bottom clip end engages said cover flange, said top clip end engages said clip flange, said drip flange extends past a front of said cover plate, said drip flange is located above a top of said cover plate.

2. The drip edge for attachment to an edge of a roof of claim 1 wherein:

a retention projection extends upward from an end of said clip flange.

3. The drip edge for attachment to an edge of a roof of claim 2 wherein:

a snap lock is formed in said top clip end to engage said retention projection.

4. The drip edge for attachment to an edge of a roof of claim 1 wherein:

a plurality of fastener openings are formed through a length of said base portion, wherein said drip edge is attached to a vertical portion of a roof by inserting a plurality of fasteners through said plurality of fastener openings and threading said plurality of fasteners into the vertical portion of the roof.

5. The drip edge for attachment to an edge of a roof of claim 1 wherein:

a plurality of horizontal grooves are formed in said base portion at substantially a bottom thereof.

6. The drip edge for attachment to an edge of a roof of claim 1 wherein:

a corner anchor bar includes two said anchor bars joined to each other to form an L-shape.

7. The drip edge for attachment to an edge of a roof of claim 1 wherein:

a corner cover plate includes said cover plate terminated on an end with a corner end plate.

8. A drip edge for attachment to an edge of a roof, comprising:

an anchor bar includes a base portion, a drip flange, a sealing flange, an offset leg, a cover flange and a clip flange, said drip flange extends outward from a top of said base portion, said sealing flange extends from said top of said base flange in a direction opposite said drip flange, said offset leg extends outward from a bottom of said base portion, said cover flange extends downward from a bottom of said offset leg, said clip flange extends outward from said base portion below said drip flange; and a cover plate includes a plate portion, a top clip end and a bottom clip end, said top clip end extends inward from a top of said plate portion, said bottom clip end extends inward from a bottom of said plate portion, wherein said bottom clip end engages said cover flange, said top clip end engages said clip flange, said drip flange extends past a front of said cover plate, said drip flange is located above a top of said cover plate.

9. The drip edge for attachment to an edge of a roof of claim 8 wherein:

a retention projection extends upward from an end of said clip flange.

10. The drip edge for attachment to an edge of a roof of claim 9 wherein:

a snap lock is formed in said top clip end to engage said retention projection.

11. The drip edge for attachment to an edge of a roof of claim 8 wherein:

a plurality of fastener openings are formed through a length of said base portion, wherein said drip edge is attached to a vertical portion of a roof by inserting a plurality of fasteners through said plurality of fastener openings and threading said plurality of fasteners into the vertical portion of the roof.

12. The drip edge for attachment to an edge of a roof of claim 8 wherein:

a plurality of horizontal grooves are formed in said base portion at substantially a bottom thereof.

13. The drip edge for attachment to an edge of a roof of claim 8 wherein:

a corner anchor bar includes two said anchor bars joined to each other to form an L-shape.

14. The drip edge for attachment to an edge of a roof of claim 8 wherein:

a corner cover plate includes said cover plate terminated on an end with a corner end plate.

15. A drip edge for attachment to an edge of a roof, comprising:

an anchor bar includes a base portion, a drip flange, a sealing flange, a cover flange and a clip flange, said drip flange extends outward from a top of said base portion, said sealing flange extends from said top of said base flange in a direction opposite said drip flange, a plurality of lengthwise grooves are formed in a bottom of said sealing flange, said cover flange extends from a bottom of said base portion, said clip flange extends outward from said base portion below said drip flange; and a cover plate includes a plate portion, a top clip end and a bottom clip end, said top clip end extends inward from a top of said plate portion, said bottom clip end extends inward from a bottom of said plate portion, wherein said bottom clip end engages said cover flange, said top clip end engages said clip flange, said drip flange extends past a front of said cover plate, said drip flange is located above a top of said cover plate, said drip flange does not contact said cover plate.

16. The drip edge for attachment to an edge of a roof of claim 15 wherein:

a retention projection extends upward from an end of said clip flange.

17. The drip edge for attachment to an edge of a roof of claim 16 wherein:

a snap lock is formed in said top clip end to engage said retention projection.

18. The drip edge for attachment to an edge of a roof of claim 15 wherein:

a plurality of fastener openings are formed through a length of said base portion, wherein said drip edge is attached to a vertical portion of a roof by inserting a plurality of fasteners through said plurality of fastener openings and threading said plurality of fasteners into the vertical portion of the roof.

19. The drip edge for attachment to an edge of a roof of claim 15 wherein:

a non-curing sealant is placed in said plurality of lengthwise grooves.

* * * * *